United States Patent [19]

Stelk

[11] Patent Number: 5,022,593

[45] Date of Patent: Jun. 11, 1991

[54] HEAVY DUTY SPIDER ASSEMBLY FOR A HAMMERMILL

[75] Inventor: John C. Stelk, Bettendorf, Iowa

[73] Assignee: Sivyer Steel Corporation, Bettendorf, Iowa

[21] Appl. No.: 554,139

[22] Filed: Jul. 16, 1990

Related U.S. Application Data

[63] Continuation of Ser. No. 321,771, Mar. 10, 1989, abandoned.

[51] Int. Cl.[5] ..... B02C 13/28

[52] U.S. Cl. ..... 241/194; 241/197

[58] Field of Search ..... 241/88.4, 189 R, 193, 241/194, 197

[56] References Cited

U.S. PATENT DOCUMENTS 4,222,530 9/1980 Whitney ..... 241/194

4,650,129 3/1987 Newell et al. ..... 241/73

4,729,516 3/1988 Williams, Jr. ..... 241/186.4

*Primary Examiner*—Timothy V. Eley

*Attorney, Agent, or Firm*—Foley & Lardner

[57] ABSTRACT

A heavy duty hammermill having a fragmentizing chamber and a hammer assembly mounted for rotary motion in the chamber and cooperating with a cutting comb and grate bars for fragmentizing auto parts fed into the chamber, the hammermill assembly being formed from a number of spiders mounted on a drive shaft and an end disc mounted on the shaft at each end of the spider assemblies, the spiders being spaced apart equal distances by spacer members provided between each pair of spiders and the end discs, each spider assembly including a spider having six arms with freely rotating hammers mounted on hammer pins in the spaces between the arms, the spider arms having a hub portion spaced outwardly from the spacer members and protective caps mounted on the impact areas of the spider arms and end discs.

10 Claims, 4 Drawing Sheets

HEAVY DUTY SPIDER ASSEMBLY FOR A HAMMERMILL

This is a continuation of U.S. Ser. No. 321,771 filed on Mar. 10, 1989, now abandoned.

BACKGROUND OF THE INVENTION

1. Field of the Invention

This invention generally relates to a hammermill and, particularly to a heavy duty hammer assembly for a hammermill of the type used to break up discarded automobile bodies.

2. Description of the Prior Art

Hammermills of the type contemplated herein are widely used to reduce large metal objects, such as cars, into small metal fragments by the rotation of a hammermill assembly within the housing of the hammermill. Hammermills of this general type are shown in U.S. Letters Pat. No. 4,222,530 issued Sept. 16, 1980, entitled "Replaceable Protective Means For End Disk of Shredder" and assigned to the same assignee. The assembly disclosed in this patent is formed by a plurality of 3 arm spiders which are alternately off set and axially aligned on the shaft in the hammermill housing. A hammer can then be mounted between the arms of every other spider with sufficient space to allow the hammers to rotate freely on the spider arms.

These hammermills are being used to shread heavy metal scrap commonly denominated #2 scrap which has resulted in an increase in down time due to repair and replacement of over stressed parts. The hammer assembly generally includes thirteen three arm spiders mounted on the drive shaft with an end plate at each end of the spiders. The drive shaft is provided with bearing sleeves at each end and key ways on diametrically opposite sides of the drive shaft. Each alternate spider requiring a key on the opposite side of the shaft to properly align the arms of the spiders in six rows. With this arrangement up to thirty-nine hammers could be mounted on the spider arms however only ten to twenty-four hammers are normally used.

The spider arms on each spider are spaced 120° apart around a hub portion that has a diameter corresponding to the diameter of a circle passing through the axis of the tie rod holes in the spiders. The spider arms extend radially outwardly from the hub portion a radial distance approximately twice the radius of the axis circle of the tie rod holes. With this arrangement stress areas have been noted in the spider arms when shredding heavy scrap which have caused cracking at the outer ends of the arms as well as at the intersection of the spider arms with the hub.

SUMMARY OF THE INVENTION

The heavy duty hammer assembly of the present invention is specifically designed for use in fragmenting #2 scrap metal using the same basic dimensions of the standard hammermill. This has been achieved primarily by using spiders having six arms. The spiders are mounted on a drive shaft with spacer members provided between the spiders and end discs to provide room for the hammers. Up to 24 hammers can be mounted on the spiders. The hammer assembly normally using 10 to 14 hammers. The improved hammer assembly having the same dimensions for the drive shaft and the mounting holes for the tie rods and hammer pins as in the presently used hammer assembly.

The spiders are provided with a hub portion having a diameter substantially greater than the diameter of the circle for the tie rod holes. This has been achieved by the spacers which have been positioned between the spiders to provide the clearance for the hammers thus allowing for a larger hub portion on the spider. One of the primary advantages of this arrangement is the reduced length of the spider arms projecting radially outwardly from the hub portion.

Another feature of the invention is the modification of the drive shaft to eliminate the bearing sleeve previously provided on each end of the shaft. This has been achieved by tapering the ends of the drive shaft to provide a bearing section between the center section and the drive section.

A still further feature of the invention is the increase in strength of the drive shaft by providing a single key way in the shaft for both the spiders and the spacer members.

One of the primary advantages of the invention is the increase in strength of the arms on the spider due to the increased diameter of the hub portion of the spider which is made possible by the use of spacer members between the spiders to allow for free rotation of the hammers.

A further advantage of the present invention is the ability to use the hammer assembly of the present invention in the same housing presently being used for hammermills.

Other features and advantages of the invention will become apparent upon review of the following drawings, the detailed description and the appended claims.

Figure 1:
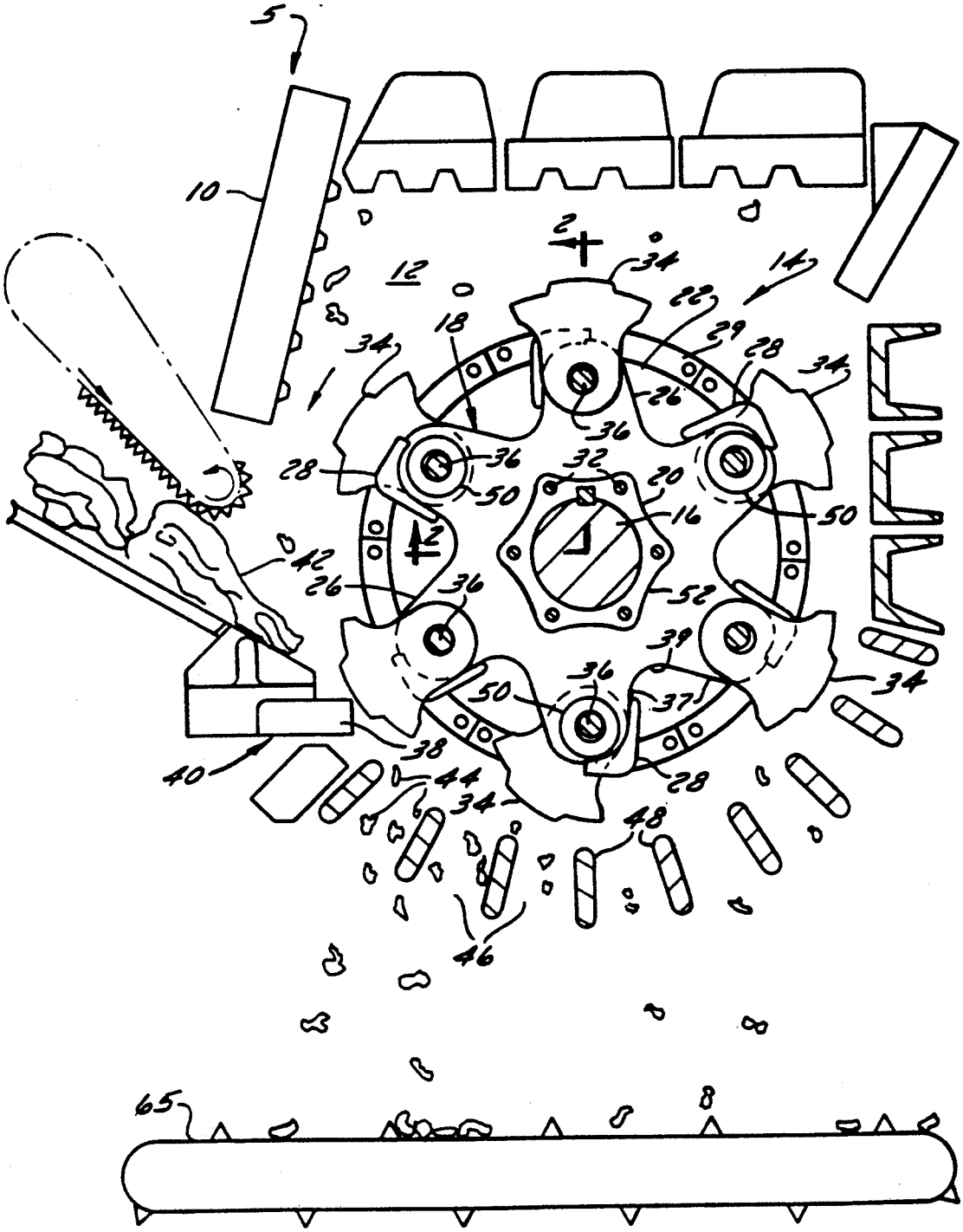
FIG. 1 is a sectional end view of a hammermill showing the hammer assembly according to the present invention.
Figure 2:
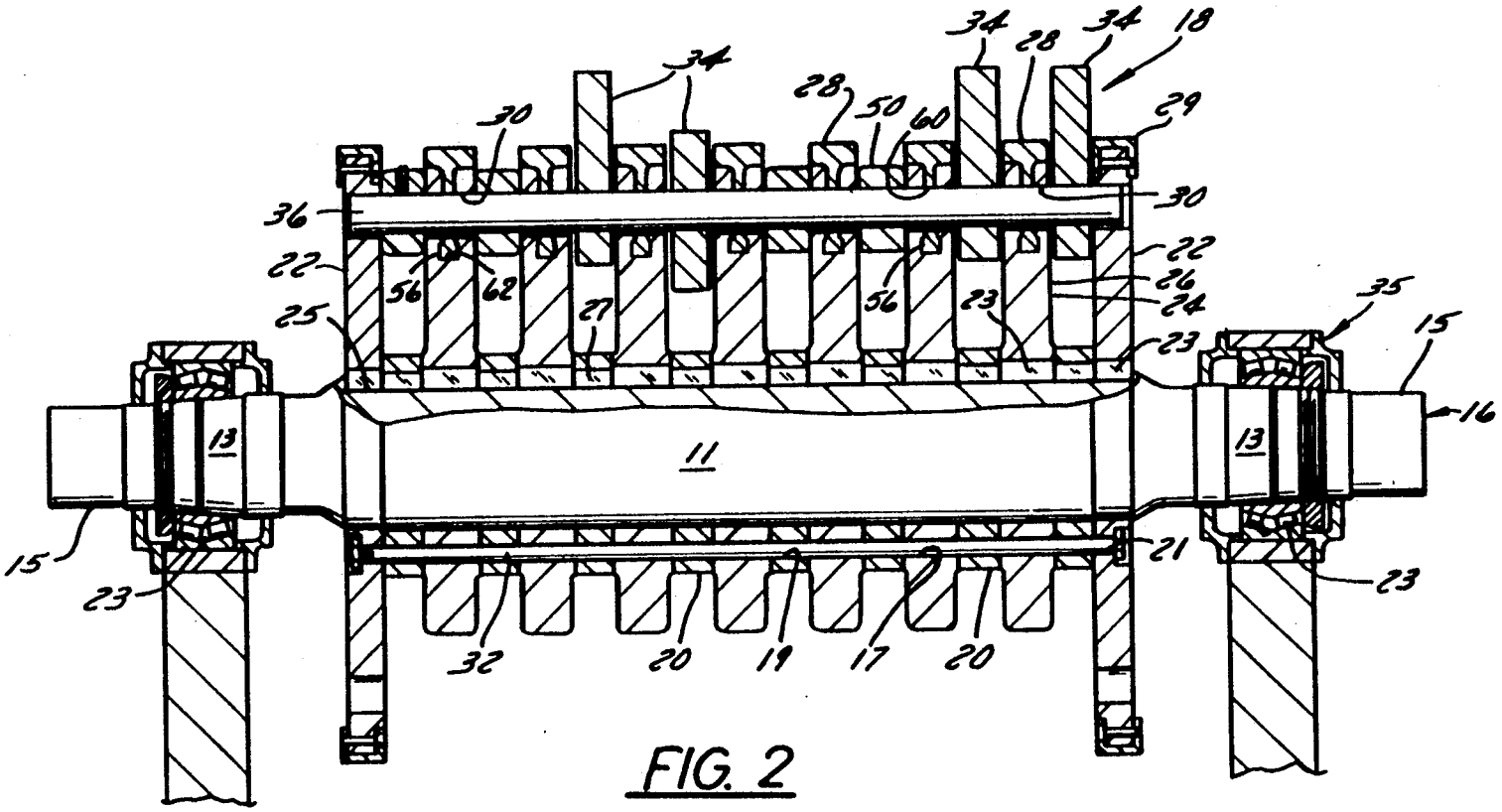
FIG. 2 is a view taken on line 2—2 of FIG. 1 showing the arrangement of the 6 arm spiders and spaces on the drive shaft.
Figure 3:
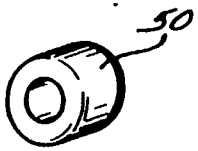
FIG. 3 is a perspective view of a hammer pin ring.

Before describing one embodiment of the invention in detail, it is to be understood that the invention is not limited in its application to the details of construction nor the arrangement of components set forth in the following description and illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF A PREFERRED EMBODIMENT OF THE INVENTION

Referring to the drawings, a hammermill 5 of the type contemplated herein is shown which includes a housing 10 having a fragmentizing chamber 12, a drive shaft 16 mounted for rotation within the chamber 12, a rigidly mounted cutting comb 40 and grate bars 48. The hammer assembly 14, according to the present invention, includes a number of spiders 18 mounted on the drive shaft 16 with an end disk 22 mounted on the shaft 16 at each end of the spiders 18. The spiders 18 and end disc 22 are equally spaced on the drive shaft 16 by means of spacer members 20.

In accordance with one aspect of the invention, the drive shaft 16 is formed as a single unit having a central section 11, which tapers outwardly to a bearing section 13. The bearing section 13 tapers outwardly to a drive section 15. With this arrangement, bearings 23 can be mounted directly on the bearing section 13 and retained thereon by means of bearing housings 35. This arrangement eliminates the requirement for a sleeve on the shaft to support the bearing. The shaft 16 is supported in the housing 10 by means of the housing 35 which is mounted on a pedestal 37. The shaft has also been strengthened by providing a single key way 25 in the central section 11. The drive shaft 16 is driven by a motor (not shown) connected to one of the drive sections 15.

The spiders 18 are spaced at equal intervals on the shaft by means of spacer members 20 which are also placed between the last spiders 18 at each end and the end disks 22. The spiders 18, spacer members 20, and end discs 22 each include a number of holes 17, 19 and 21, respectively, which are aligned to provide an opening through the assembly for the tie rods 32. The spiders 18 and end discs 22 are aligned on the drive shaft by keys 23. It should be noted that the spiders 18 require only a single key way 25 in the central section 11 of the shaft. The three arm spiders formerly used require two key ways in the shaft to properly align the spider arms. Spacer members 20 are axially aligned on the shaft 16 by means of keys 27 which are also inserted into key way 25 and are secured to the spiders 8 and end discs 22 by means of tie rods 32 which pass through the holes 17, 19, and 21. Hammers 34 are supported in the spaces between the spiders 18 by means of hammer pins 36 which pass through the openings 30 in the ends of each row of axially aligned spider arms 26.

Figure 6:
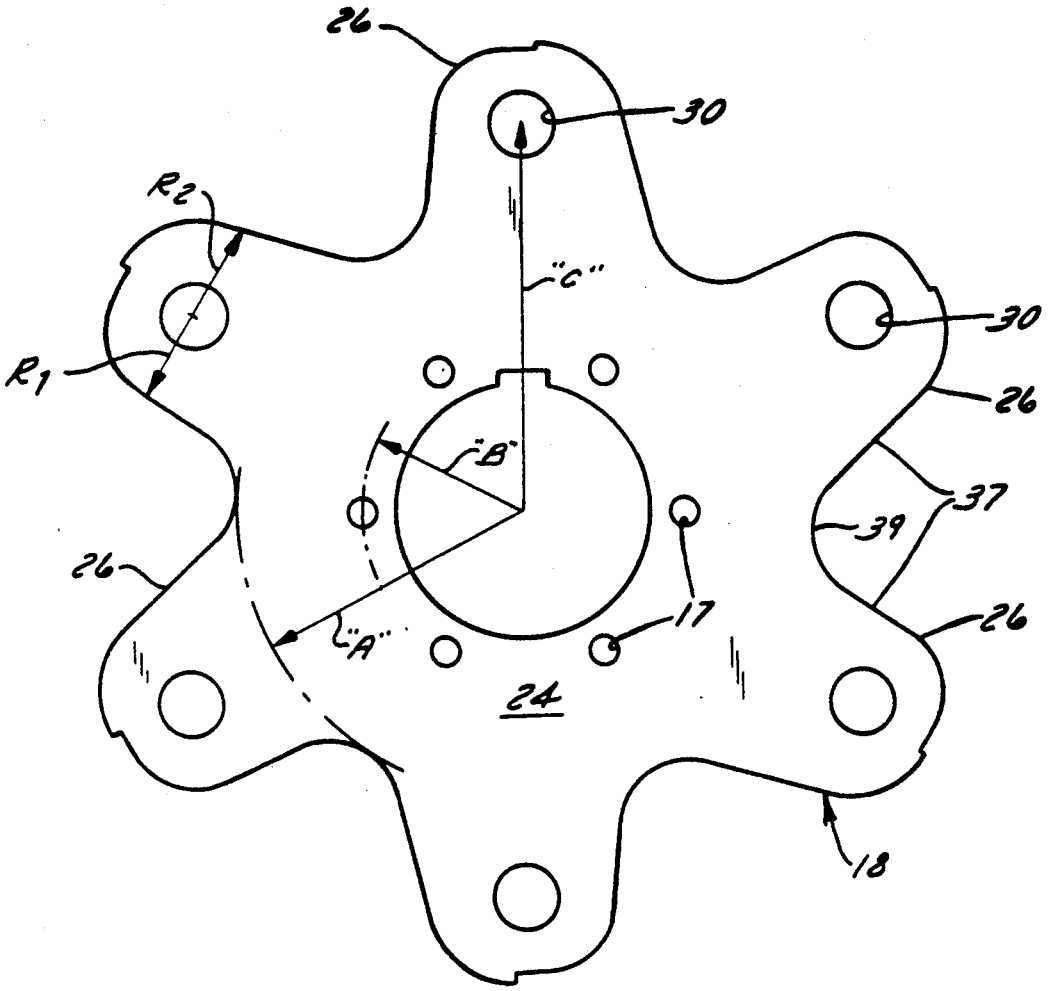
FIG. 6 is a side elevation view of a six arm spider.

The capability of the hammer assembly 14 to operate in a heavy duty hammermill is due to the use of six arm type spiders 18. In this regard, each of the spiders 18, as shown in FIG. 6, includes a hub portion 24 that has a radius "A" that is greater than the radius "B" of the circle of the axis' of the tie rod openings 17 and smaller than the radius "C" of the circle of the axis' for the hammer pin openings 30. In one embodiment of the spider shown in FIG. 6, the radius "A" is 23 inches and the radius "B" is 13 inches and the radius "C" is 31 inches. Radius "A" is, therefore, approximately half way between radii "B" and "C". Radius A is therefore approximately equal to the length of radius B plus one-half the difference between the length of radius C and the length of radius B. By increasing the radius of the hub portion 24, the length of the spider arms is reduced to less than half the length in conventional three arm type spiders. The stress area at the intersection of the spider arms 26 with the hub portion 24 of the spider 28 is moved radially outwardly of the hole circle "B" resulting in a shorter moment arm in the spider arms 26 thereby reducing stress at the juncture of the spider arm with the hub portion 24.

It should be noted that the three arm spiders are mounted side by side on the drive shaft with the hammer spaces provided between the spider arms of every other spider. The hub portion of the three arm spiders, therefore, cannot be extended beyond the tie rod hole circle since there must be sufficient space for the hammers to rotate freely between the spider arms. The spacer members 20 between the spiders 18 are provided with curved surfaces 52 which allow the hammers 34 to rotate freely around hammer pins 36. On the other hand, six arm spiders 18 are mounted in a fixed spaced relation by means of the spacer members 20. The hammers 34 are mounted between the spider arms 26 and the outer portion of the hub portion 24 with the spacer members 20 providing clearance for the freely rotating hammers 34.

In operation, the free swinging hammers 34 rotate with respect to the hammer pins 36 and co-act with the teeth 38 of the rigidly mounted cutting comb 40 that extends the length of the hammer assembly 14. The material 42 which enters the chamber 12 is broken up by the swinging motion of the hammers 34 into small pieces or fragments 44 which fall through spaces 46 between grate bars 48. The fragments 44 are collected on a delivery conveyor 65 which carries the fragments from the shredder housing.

The hammers 34, comb 40, and grate bars 48 are formed from specially treated hardened steel which is resistant to the hammering effect of the fragmentized material. The spiders 18 and end disks 22, because of their size and shape, are more effectively cast of softer steel and protected by caps 28 and 29, respectively.

Figure 4:
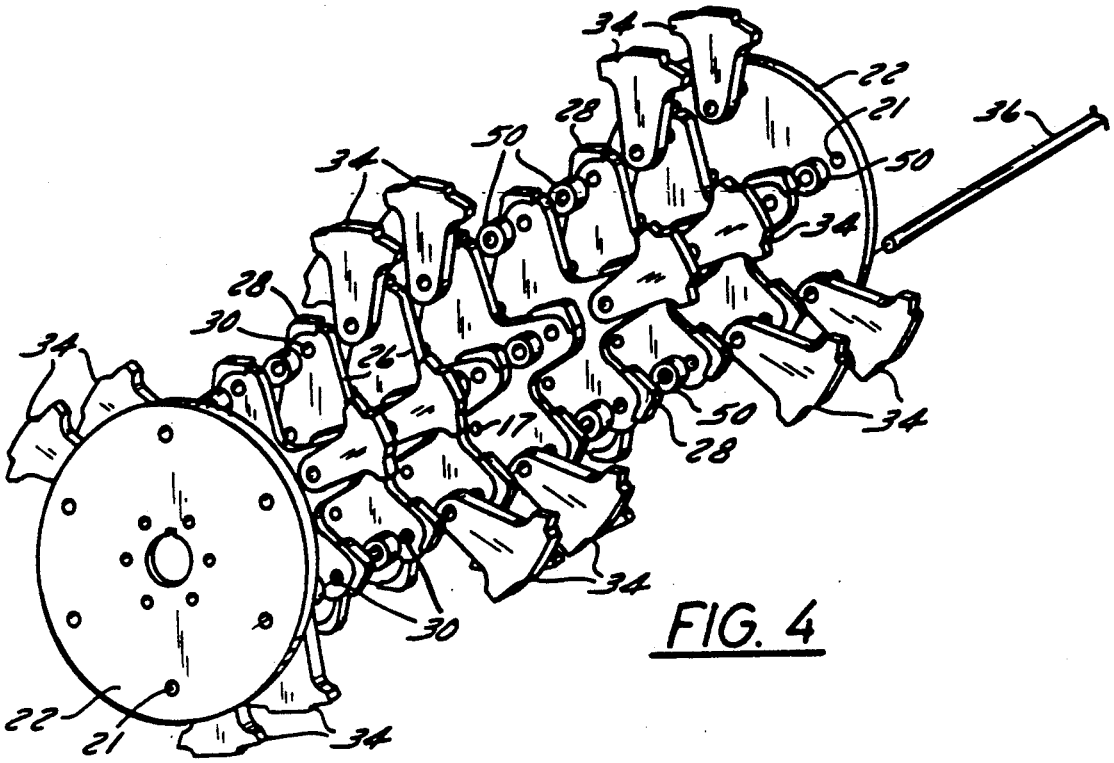
FIG. 4 is an exploded perspective view of the hammer assembly according to the present invention.

The hammer assembly shown in FIG. 4 is capable of carrying twenty-four hammers 34. The spacing between the hammer pin holes 30 at the ends of adjacent arms 26 is not far enough apart to allow for hammers 34 to be mounted on adjacent spider arms. Although it is possible to mount twenty-four hammers 34 on the hammer assembly, there generally are only ten to sixteen hammers on the hammer assembly.

Means are provided to protect the hammer pins 36 from impact with the fragmented pieces 44 which causes erosion and wear of the exposed portions of the hammer pins 36. Such means is in the form of a ring or donut 50. The donut 50 is made of hard, wear-resistant steel similar to the material used to make the protective caps 28 and is positioned on the hammer pins 36 to protect the hammer pins 36 from engagement with the fragmentized materials.

Figure 5:
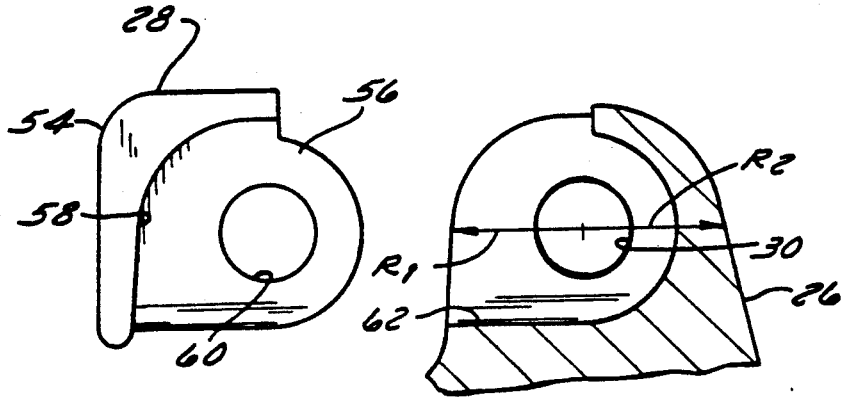
FIG. 5 is an exploded view of the end cap for the tip of the spider arm.

The protective caps 28 as shown in FIG. 5 each include a shroud 54 and a web 56 that projects inwardly from the inner face 58 of the shroud 54. The web 56 includes an opening 60 which corresponds to openings 30 in the spider arm 26 and matingly engages a slot 62 formed in the end of arm 26. Means have been provided to increase the strength of the end of the arms 26 to reduce stress around the holes 30. This has been accomplished by increasing the thickness $R_2$ on the back of the arm 26 from the center of hole 30 so that it is greater than the thickness $R_1$ of the front of the arm 26.

Thus, it is apparent that there has been provided, in accordance with the invention, a heavy duty hammer assembly that fully satisfies the aims and advantages set forth above. While the invention has been described in conjunction with specific embodiments thereof, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A heavy duty hammermill having a fragmentizing chamber and a hammer assembly mounted for rotary motion in said chamber, said hammer assembly coacts with a cutting comb and circumferentially spaced grate bars to fragmentize material fed into the chamber of the hammermill, the hammer assembly including:

a drive shaft mounted for rotary motion in the chamber;

a plurality of spiders mounted on the shaft; and an end disc mounted on said shaft at each end of said spiders, each spider having six equally radially spaced arms, a hammer pin opening at the outer end of each arm and corresponding openings in each of said end discs;

spacer members mounted on said shaft between said spiders and said end discs;

a number of tie rod openings in each of said spiders located at equally spaced distances from the axis of the drive shaft each of said spiders including a hub portion having a radius approximately equal to the length from a tie rod opening to the drive shaft axis plus half the difference between the length from a hammer pin opening to the drive shaft axis and the length from a tie rod opening to the drive shaft axis, a hammer pin mounted in each row of spider arms, and a number of freely swinging hammers mounted for rotary motion on said hammer pins in the spaces formed by said spacer members between said spiders;

said hammers rotating freely about the pins in an orbit sufficiently close to the comb to fragmentize heavy material.

2. The hammer assembly according to claim 1 including means for protecting the exposed portions of said hammer pins between said spider arms from wear.

3. The hammer assembly according to claim 2 wherein said protecting means comprises a ring made of hardened, wear resistant steel.

4. The hammer assembly according to claim 1 including protective caps mounted on the impact area at the end of each spider arm.

5. The hammer assembly according to claim 4 wherein said protective caps each include a shroud shaped to engage the outer portion of the tip of the spider arm and a web projecting inwardly from the inner face of the shroud and matingly engaging a slot provided in the spider arm.

6. The hammer assembly according to claim 5, wherein said shroud is made of a hardened, wear resistant steel.

7. The hammer assembly according to claim 1 wherein said drive shaft includes a single key way along one side, said spiders and spacer members include a single key way corresponding to the said key way in said shaft and a key for securing each of said spiders and spacer members to said shaft.

8. A hammer assembly for a hammermill of the type having a housing forming a fragmentizing chamber, said hammer assembly being mounted for rotary motion in the chamber and comprising:

a drive shaft mounted for rotary motion in the housing;

a number of six arm type spiders axially aligned on said shaft, spacer members mounted on said shaft between said spiders, said spiders each include a number of tie rod openings located at equally spaced distances from the axis of said drive shaft, each spider arm including a hammer pin opening at the outer end, said hammer pin openings being located at equally spaced distances from the axis of said drive shaft, said spider arms being aligned in rows with said hammer pin openings in axial alignment, each spider including a hub portion having a radius which is approximately equal to the distance of a tie rod opening from said drive shaft plus half the difference of the distance from a hammer pin opening to the drive shaft and the distance from a tie rod to the drive shaft;

and a number of hammers mounted for rotation on said hammer pins in the spaces formed by said spacer members between said spiders.

9. The assembly according to claim 8 including an end disc mounted on said shaft at each end of said spiders and a spacer member positioned between each end disc and the adjacent spider.

10. The assembly according to claim 8 including means on said hammer pins for protecting the exposed portions of said hammer pins in the spaces between the spider arms.

* * * * *